US005233791A

United States Patent [19]

McQueen, Jr.

[11] Patent Number: 5,233,791

[45] Date of Patent: Aug. 10, 1993

[54] APPARATUS FOR GRINDING THE INTERNAL SURFACE OF PIPE

[76] Inventor: Joe C. McQueen, Jr., 8513 N. Golder, Odessa, Tex. 79764

[21] Appl. No.: 844,714

[22] Filed: Mar. 2, 1992

[51] Int. Cl.[5] ..... B24B 5/40

[52] U.S. Cl. ..... 51/34 C; 51/349

[58] Field of Search ..... 51/34 C, 32, 34 H, 34 G, 51/38, 331, 349, 267, 290, 319, 326, 352

[56] References Cited

U.S. PATENT DOCUMENTS

| | | | |
|---|---|---|---|
| 1,475,079 | 11/1923 | Miller | 51/267 |
| 1,593,044 | 7/1926 | Stubbs | 15/198 |
| 1,779,161 | 10/1930 | Douglas | 51/34 C |
| 1,927,391 | 9/1933 | Coberly | 29/81.021 |
| 2,057,842 | 10/1936 | Nielsen | 15/104.09 |
| 2,290,739 | 7/1942 | Chapman | 51/349 |
| 2,312,012 | 2/1943 | Wallace | 51/349 |
| 2,320,747 | 6/1943 | Peterson | 51/349 |
| 2,353,409 | 7/1944 | McClure | 51/352 |
| 2,354,289 | 7/1944 | Babb | 409/140 |
| 2,466,644 | 4/1949 | McBride | 72/40 |
| 2,792,807 | 5/1957 | Cummings | 118/72 |
| 2,818,688 | 1/1958 | Swedmark | 51/103 WH |
| 2,917,762 | 12/1959 | Xenis | 15/104.05 |
| 2,988,859 | 6/1961 | Chaffey | 51/349 |
| 3,004,278 | 10/1961 | Stanley | 15/319 |
| 3,237,350 | 3/1966 | Estabrook | 51/290 |
| 3,460,292 | 8/1969 | Feschland | 51/34 R |
| 4,131,005 | 12/1978 | Pridy | 72/40 |
| 4,290,163 | 9/1981 | Opitz | 15/104.09 |
| 4,299,282 | 1/1981 | Thornton | 166/177 |
| 4,418,437 | 12/1983 | French | 15/104.09 |
| 4,682,397 | 7/1987 | Harth, III | 29/407 |
| 4,798,246 | 1/1989 | Best | 166/311 |

FOREIGN PATENT DOCUMENTS

| | | | |
|---|---|---|---|
| 1371883 | 2/1988 | U.S.S.R. | 51/338 |

*Primary Examiner*—Bruce M. Kisliuk
*Assistant Examiner*—Bryan Reichenbach
*Attorney, Agent, or Firm*—Shaffrer & Culbertson

[57] ABSTRACT

An apparatus for grinding pipe comprises a tool body and means for rotating and advancing the tool body longitudinally through a pipe to be ground. At least one grinding tool is mounted on the tool body carrying a grinding element and adapted to extend outwardly to contact and grind the internal surface of the pipe when the tool body is inserted therein. Force transmitting means, transmits the pressure of a fluid contained in a tool body cavity to each grinding tool to extend the tools and apply a grinding force to the pipe. After grinding the internal surface of the pipe, the pipe is heated to a burn-out temperature, and then sandblasted on its internal surface to produce a surface for receiving a coating material.

6 Claims, 3 Drawing Sheets

APPARATUS FOR GRINDING THE INTERNAL SURFACE OF PIPE

BACKGROUND OF THE INVENTION

This invention relates to a grinding apparatus for grinding pipe, particularly in preparation for internal coating. The invention also encompasses a method for grinding the internal surface of pipe and of preparing pipe for internal coating.

Tubulars or pipe, particularly oil-field tubular products, are often coated on their internal surface to protect against corrosion. Also, pipe is often reused and usually the used pipe must be recoated prior to reuse. Regardless whether the pipe is new or used, its internal surface must be sandblasted in order to produce the desired anchor pattern for coating. In addition to providing the desired surface for coating, sandblasting is also used for removing defects and foreign material on the internal surface of the pipe. Prior to sandblasting, the new or used pipe is heated in a gas-fired oven to a burn-out temperature in order to burn or incinerate solvents, oil, old coating, and other material that would otherwise interfere with the application of the desired new coating.

A number of problems arise in preparing new and used pipe for internal coating. Although sandblasting is necessary to produce the surface required for coating, the sandblasting process is inefficient for removing certain blemishes or material on the internal surface of the pipe including, mill scale and slivers, or weld seams and weld splatter on electrical resistance welded tubulars. Oftentimes, several passes are required by the sandblasting device in order to prepare the surface. Thus the sandblasting represents a bottleneck in the coating procedure. The inefficiency problem with sandblasting is exacerbated due to recent safety dictated changes in sandblasting. Job safety regulations now require that more expensive materials be used as the abrasive in the sandblasting process.

Aside from the problems with sandblasting, the burn-out process takes a substantial period of time and uses large amounts of energy to heat the pipe, particularly used pipe. The burn-out process also releases hydrocarbons and combustion products into the atmosphere and is, therefore, detrimental to air quality. Also, some defects in used pipe that prohibit reuse can only be found after burn-out, that is, after substantial expense in heating the pipe in the burn-out procedure.

SUMMARY OF THE INVENTION

It is a broad object of the invention to provide a grinding apparatus and method for grinding the internal surface of pipe in order to prepare the pipe for blasting or burn-out and thereby reduce or eliminate the problems in blasting or burn-out described above. It is also an object of the invention to provide an improved method for preparing pipe for internal coating.

In order to accomplish these objectives, an apparatus according to the invention includes a grinding head and manipulating means for rotating and moving the grinding head longitudinally through the pipe to be ground. The grinding head includes a tool body carrying at least one grinding tool with a grinding element thereon. Each grinding tool applies a grinding pressure to the internal surface of the pipe as the grinding head is rotated and moved longitudinally by the manipulating means. Grinding with the apparatus according to the invention can remove weld splatter, mill scale, weld seams, slivers, and old coatings and is preferably done prior to burn-out to minimize the burn-out time prior to sandblasting and then internal coating. Also, grinding used pipe prior to burn-out can uncover defects in the used pipe which would make the used pipe unsuitable for reuse. This defective pipe can then be culled before wasting burn-out costs on the defective pipe.

The tool body is preferably elongated and has an outer diameter that allows the tool to be inserted into the pipe being ground. The grinding tools are movably mounted on the tool body to extend from the tool body to a maximum distance for grinding. An extending and grinding force is applied to the grinding tools by a pressurized operating fluid preferably contained in a cavity within the tool body. In the preferred form of the invention, the operating fluid is contained in an elastic bladder or bag within the cavity and the force of the fluid is applied through the elastic material to a force receiving surface associated with each grinding tool. The operating fluid pressure determines how aggressive the grinding will be, although stops on each grinding tool prevent grinding beyond allowable wall thickness limits.

The manipulating means includes an elongated outer lance member and an inner lance member supported for rotation therein. The grinding head is connected by a suitable connector to one end of the inner lance member. Drive means are connected to the outer lance member and the inner lance member to rotate the inner lance member within the outer lance member and to move both longitudinally through the pipe to be ground. A support structure supports the drive means as well as the lance structure which carries the grinding head.

In the preferred form of the invention, the apparatus further includes coolant delivery means for delivering a coolant fluid to the area around the grinding head as it rotates and advances through the pipe being ground. The coolant fluid is delivered through the annulus between the rotating inner and stationary outer lance members and also serves to cool and lubricate the bearing structures that support the inner lance member for rotation within the outer lance member.

The method of the invention for preparing pipe for internal coating comprises first grinding the internal surface of the pipe with the grinding tool. After grinding to remove old coating, mill scale, weld splatter, and other defects on the internal surface of the pipe, the pipe is sand or abrasive blasted to achieve the desired anchor pattern for coating. The preferred method also includes the step of heating the pipe to a burn-out temperature for a burn-out period after the grinding step and before sandblasting. The burn-out step is significantly shortened due to the removal of material in the initial grinding step. Removal of material in the grinding step also shortens the blasting period required and thereby further enhances the overall speed of the internal coating process.

These and other objects, advantages, and features of the invention will be apparent from the following description of the preferred embodiments, considered along with the accompanying drawings.

DESCRIPTION OF THE PREFERRED EMBODIMENTS

Figure 1:
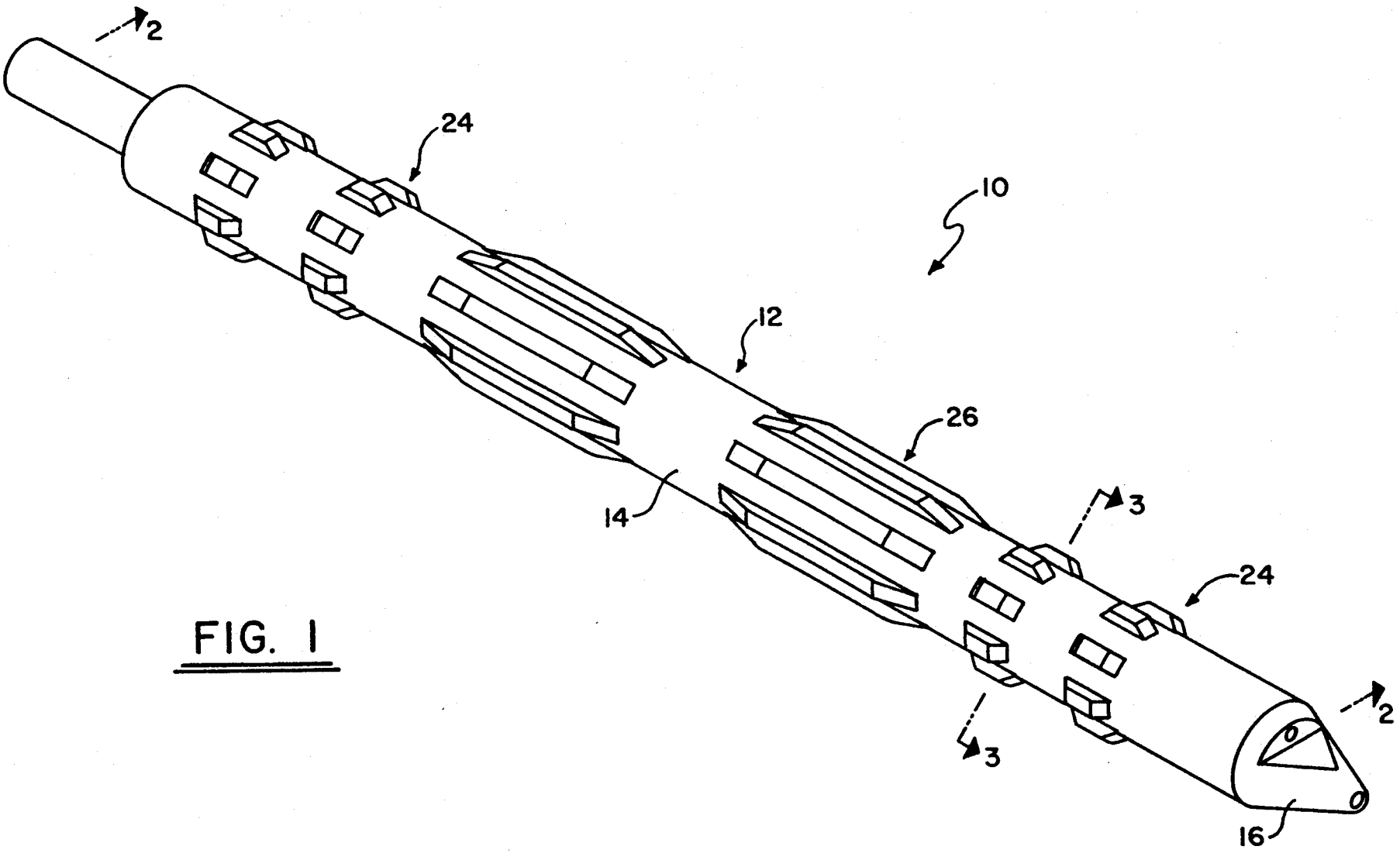
FIG. 1 is view in perspective of a grinding head embodying the principles of the invention.
Figure 2:
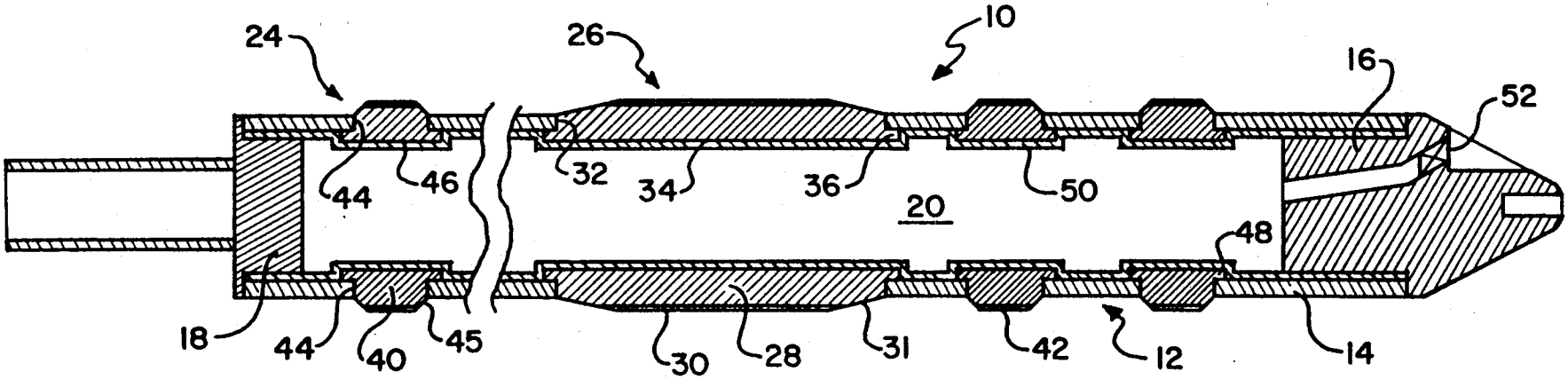
FIG. 2 is a view longitudinal section taken along line 2—2 in FIG. 1.
Figure 3:
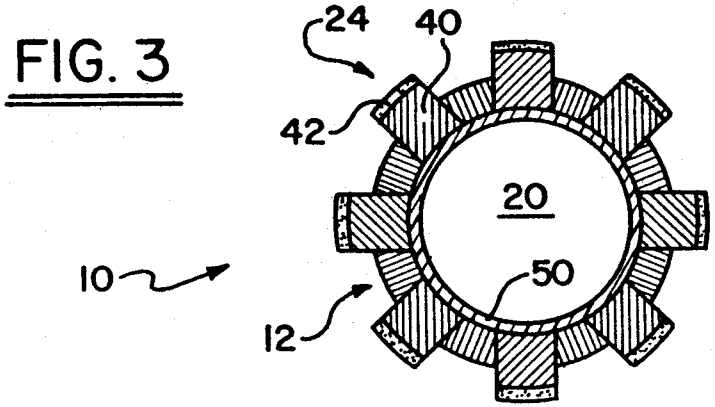
FIG. 3 is an enlarged view in transverse section taken along line 3—3 in FIG. 1.

FIGS. 1 through 3 show a grinding head 10 embodying the principles of the invention. The device 10 includes a tool body 12 made of suitable durable material and comprising a generally cylindrical section 14, a forward bulkhead 16, and a rear bulkhead 18. As shown in FIGS. 2 and 3, the tool body 12 also includes a cavity 20 for receiving an operating fluid.

The grinding head 10 also includes at least one and preferably a plurality of grinding tools. The embodiment shown in FIGS. 1 through 3 includes two types of grinding tools, small-area button tools 24 and elongated tools 26. The button tools, with their relatively small grinding area of around ⅜ inch wide and 1 inch long, are adapted to reach internal diameter transition areas such as the upset in oil and gas well tubing, for example. However, the bulk of the grinding done by the device 10 is performed by the elongated grinding tools 26.

The elongated grinding tools 26 each include a grinding element support 28 and a grinding element 30. The grinding element 30 is preferably formed from tungsten carbide or some other suitable abrasive grinding material. Each elongated grinding element support 28 includes a sloped portion 31 at each end and is slidably mounted in a slot 32 extending generally radially from the center longitudinal axis of the tool body 12. The supports 28 and slots 32 in which they are mounted are spaced out symmetrically at different angular orientations around the circumference of the tool body 12 as best shown in FIGS. 1 and 3.

Each elongated grinding element support 28 includes at its radially inner end a fluid force receiving surface 34 bounding the cavity 20 of the tool body 12. Each grinding element support 28 also includes stops or shoulders 36. The stops 36 are adapted to contact the tool body 12 to limit the radial distance to which the elongated grinding tools 26 can extend from the tool body. Thus the stops serve to prevent the elongated grinding tools 26 from grinding the pipe (not shown) beyond a desired minimum wall thickness.

The button tools 24 also each include a grinding element support 40 and a grinding element 42 similar to the elongated grinding tools 26. Each button tool 24 is also slidably mounted in a button slot 44 in the cylindrical portion 14 of the tool body 12, and the button tools are symmetrically spaced out at different angular orientations around the circumference of the tool body. Also similar to the elongated grinding tools 26, each button tool support 40 includes sloped portions 45 at each end, a fluid force receiving surface 46, and stops or shoulders 48 to limit the radial distance to which the tools can extend.

The tool body cavity 20 is adapted to contain an operating fluid under a desired operating pressure. The fluid pressure in the cavity 20 acts on the fluid force receiving surfaces 34 and 46 of the grinding tools 26 and 24, respectively, to force the grinding tools outwardly. This outward pressure is applied via the grinding elements 30 and 42 to the internal surface of the pipe to grind the surface. The fluid pressure in the cavity 20 determines the grinding force applied by the grinding tools 24 and 26. For example, fluid pressure may be in the range of 5 to 30 PSI, depending on the diameter of the tool and other factors such as the nature of the material being ground and the nature of the grinding element material.

As shown in FIGS. 2 and 3, the grinding head 10 includes an elastic bladder 50 that serves to contain the fluid in the cavity 20. The bladder 50 allows the fluid force to be applied to the force receiving surfaces 34 and 46 of the grinding tools 26 and 24, respectively, without having individual sealing elements for each grinding element support and slot arrangement. Although the elastic bladder 50 could completely line the cavity 20, the illustrated preferred form of bladder comprises a sleeve of material sealed at both ends between the respective bulkhead 16 or 18 and the tool body 12. Fluid pressure, preferably air pressure, is applied to the cavity 20 and bladder 50 through a suitable pressure fitting or valve 52 connected in the forward bulkhead 16.

Figure 4:
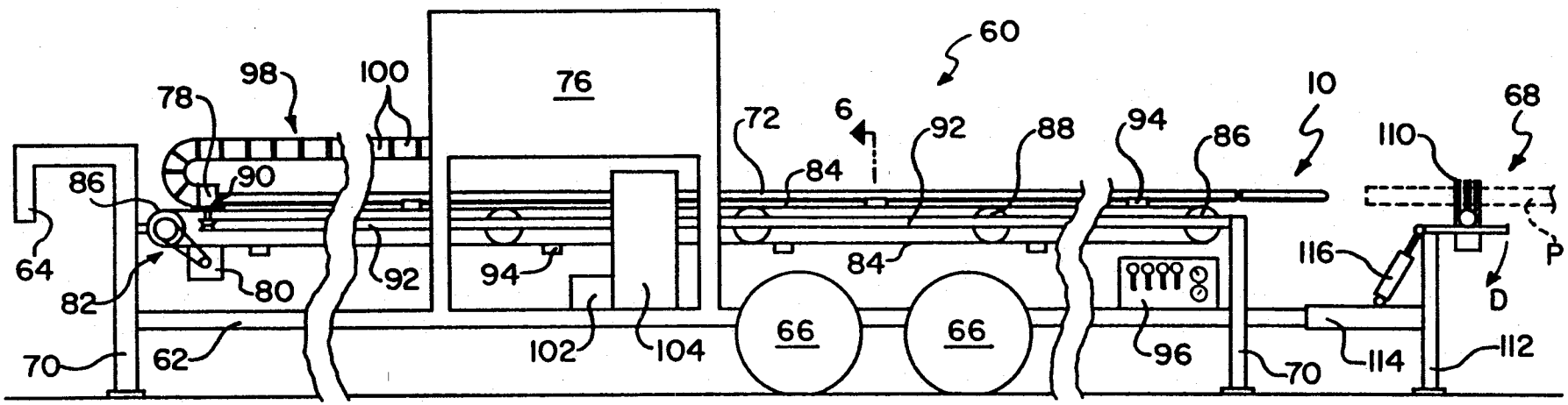
FIG. 4 is a side view of a grinding apparatus embodying the principles of the invention.
Figure 5:
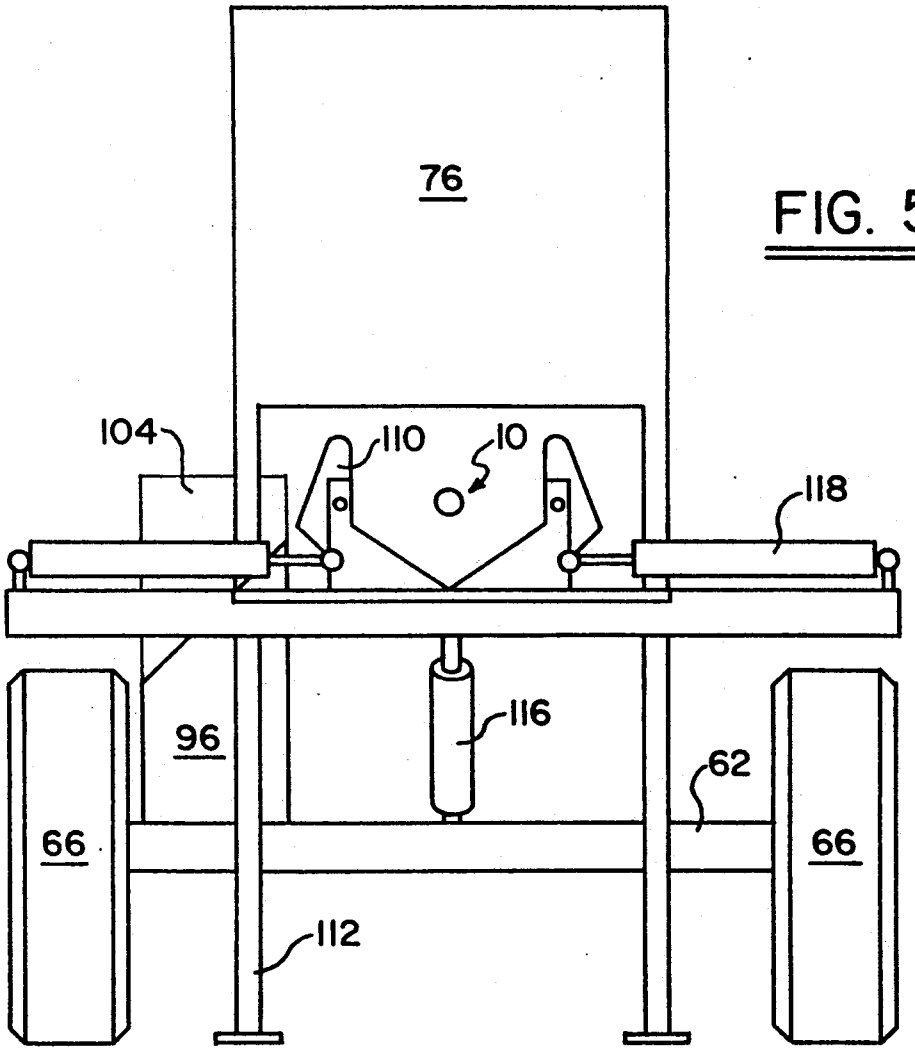
FIG. 5 is an end view of the grinding apparatus shown in FIG. 4.
Figure 6:
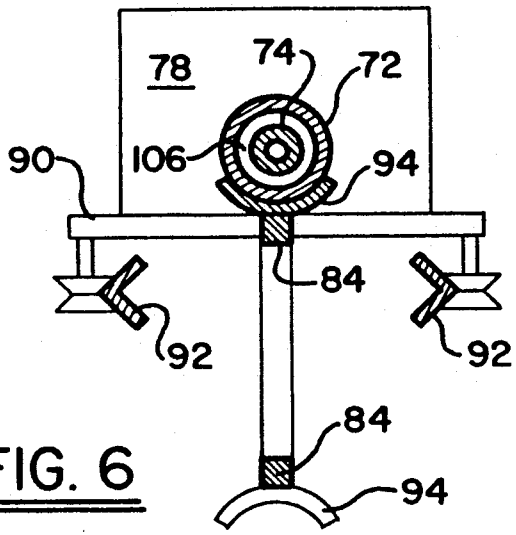
FIG. 6 is a partial view in transverse section of the grinding apparatus taken along line 6—6 in FIG. 4.

The preferred manipulating means 60 is shown best in FIGS. 4 through 6. The illustrated grinding tool manipulating means 60 is adapted to advance and rotate the grinding head 10 through a pipe P to perform the grinding operation. However, those skilled in the art will readily appreciate that the manipulating means may alternatively comprise means for rotating and advancing the pipe in relation to the grinding head.

As shown particularly in FIGS. 4 and 5, the preferred manipulating means 60 is a portable unit comprising an elongated frame 62 with a suitable hitch structure 64 at one end and supported by a set of wheels 66. The device 60 also includes pipe gripping and aligning means 68 connected at the end opposite the hitch structure 64. As shown in FIG. 4, when the device is set up for operation, the entire frame 62 and pipe gripping arrangement 68 are supported by a series of leveling and support jacks 70 which can be lowered and extended by a suitable mechanism (not shown).

The manipulating means 60 also includes a lance structure comprising an elongated outer lance member or tube 72 and an inner lance 74 to which the grinding head 10 is connected, preferably through a splined connection. The inner lance 74 is rotatably mounted within the outer lance 72 on a suitable bearing arrangement, preferably several glass impregnated nylon plastic bushings spaced out along the length of the inner lance.

Drive means are also included in the manipulating means 60 for rotating the inner lance 74 and extending both the inner lance 74 and outer lance 72 along the frame 62 to advance and rotate the grinding head 10. The drive means includes a hydraulic power unit 76 comprising a suitable power supply motor and a hydraulic fluid pump, a traveling hydraulic motor 78 connected to rotate the inner lance 74, and a longitudinal drive arrangement that includes a separate stationary hydraulic motor 80. Although the illustrated embodiment of the invention includes hydraulic motors, those skilled in the art will readily appreciate that other types of motors may be employed.

The stationary motor 80 for the longitudinal drive unit is connected to suitable gearing shown diagrammatically at 82 to drive chain 84. The chain 84 is supported on suitable end sprockets 86 and a plurality of support sprockets 88 spaced out along the length of the frame 62. Both ends of chain 84 are connected to a carriage 90 for the traveling motor so that the carriage and traveling motor 78 may be pulled in either direction along a carriage track 92 extending substantially the entire length of the frame 62. Also, as shown particularly in FIGS. 4 and 6, a plurality of lance support brackets 94 are connected to the links of the longitudinal drive chain 84. The support brackets 94 serve to support the outer lance 72 along the top flight of the chain 84. Operating the stationary drive motor 80 advances the outer and inner lances 72 and 74, respectively, and grinding head 10 first to the right in FIG. 4. Once the grinding head 10 has traversed the length of the pipe being ground, the stationary motor 80 may be reversed to move the outer and inner lances and grinding head to the left in FIG. 4 and retract the grinding head from the pipe being ground.

Both the stationary longitudinal drive motor 80 and the traveling motor 78 are controlled and driven through a control panel 96 mounted at a convenient location on the frame 62. Although not shown in the figures, those skilled in the art will readily appreciate that hydraulic lines run from the hydraulic unit 76 to both the stationary longitudinal drive motor 80 and the traveling motor 78, and to the control panel 96. Since the longitudinal drive motor 80 is stationary, the hydraulic lines connecting it to the hydraulic unit 76 may be fixed in place along the frame 62. However, since the traveling motor 78 moves along the length of the frame 62 on the carriage 90, a suitable hydraulic line feeding arrangement is required. As shown particularly in FIG. 4, a link structure 98 preferably feeds hydraulic lines (not shown) from the hydraulic unit 76 to the traveling motor 78. The link structure 98 comprises a plurality of large links 100 which are adapted to rotate downwardly to follow the traveling motor 78 as it moves to the right in FIG. 4. The links 100 have limited rotational movement upwardly so as to form a supporting structure when the traveling motor 78 is retracted to the left in FIG. 4 as shown. Although the illustrated one way link system marketed under the mark POWER TRAC is preferred, the hydraulic lines to the traveling or inner lance drive motor 78 may be supported in any fashion allowing movement of the motor 78 along the frame 62.

Referring to FIGS. 4 and 6, the preferred form of the invention includes a coolant delivery system for providing coolant to the area around the grinding head 10 as the grinding head advances and rotates through the pipe being ground. The preferred coolant delivery arrangement includes a suitable coolant pump 102, a coolant reservoir 104, and connecting lines (not shown) for supplying coolant from the pump to the annular space 106 (FIG. 6) between the inner and outer lance members 74 and 72, respectively. The coolant pump 102 may be operated from controls positioned on the control panel 96 and the preferred coolant comprises water. In operation, as the grinding head 10 is rotated and advanced through the pipe being ground, the coolant is pumped into the annular space 106 between the inner and outer lance members 74 and 72, at a point near the traveling motor 78 and the coolant exits the annular space by leaking past the bushing (not shown) at the grinding head end of the lance structure. By passing the coolant through the annulus between the outer lance 72 and inner lance 74 the coolant fluid serves both to cool and lubricate the bushings in the lance structure and to cool and lubricate the grinding tools carried by the grinding head 10.

As shown particularly in FIGS. 4 and 5, the pipe gripping and aligning means 68 includes a plurality of hydraulically actuated gripping fingers 110 adapted to close about the pipe to be ground. The gripping fingers 110 are supported on a separate frame 112 connected to the frame 62 by an extension 114 that may be extended sufficiently to allow the fingers to grip the pipe P. Also, the gripping fingers 110 are adapted to pivot downwardly as indicated by arrow D to enable pipe to be rolled into and out of position without having to realign the gripping finger support frame 112. The downward pivot of the fingers 110 is controlled with hydraulic actuator 116 while the fingers 110 are operated by actuators 118.

In operation the grinding apparatus comprising the grinding head 10 and manipulating means 60 are positioned as shown in FIG. 4 in relation to the pipe P to be ground or prepared for internal coating. The cavity 20 of the grinding head is charged through the fitting 52 with a gas to apply a desired grinding force to the grinding tools 24 and 26. The traveling motor 78 rotates the inner lance 74 and grinding head 10 and the stationary motor 80 drives the chain 84 to pull the carriage 90, traveling motor 78, and lances 72 and 74 to the right in FIG. 4, to enter the pipe P. The sloped portions 31 and 45 of the elongated and button tools, respectively, enable the grinding head 10 to pass smoothly into the pipe without hanging up. The grinding elements 30 and 42 of the rotating and advancing grinding head 10, press against the internal surface of the pipe P to grind away surface defects and to remove the majority of old coating that may be present. Coolant fluid is pumped through the annulus 106 between lances 72 and 74, cooling the bearing surfaces and exiting at the grinding head 10 to provide cooling and lubrication as it advances. Reversing the stationary motor 80 after the grinding head 10 passes through the length of the pipe P pulls the carriage 90, traveling motor 78, lances 72 and 74, and grinding head to the left in FIG. 4 eventually to the starting position shown.

Once the internal surface of the pipe P is ground, it is preferably inspected for irreparable defects at its ends and then passed to a burn-out oven if no defects are found. After burn-out, the pipe is then sandblasted to remove any residue remaining and produce the anchor pattern in the pipe material for receiving the desired coating material.

The above-described preferred embodiments are intended to illustrate the principles of the invention, but not to limit the scope of the invention. Various other embodiments and modifications to these preferred embodiments may be made by those skilled in the art without departing from the scope of the following claims.

I claim:

1. An apparatus for grinding the cylindrical internal surface of tubular members, the apparatus comprising:

(a) an elongated tool body having a cavity therein;

(b) tool body manipulating means connected to the tool body for positioning the tool body longitudinally within an elongated tubular member and for rotating the tool body about a tool body longitudinal axis extending generally parallel to a longitudinal axis of the tubular member;

(c) a plurality of elongated grinding tools each having a grinding element mounted thereon, each elongated tool extending generally parallel to the longitudinal axis of the tool body and being movably connected to the tool body so that the radial distance between the grinding element mounted thereon and the tool body longitudinal axis may be varied, the elongated grinding tools being spaced out at different angular orientations about the tool body longitudinal axis;

(d) a plurality of button grinding tools, each having a button grinding element mounted thereon and being positioned at a different angular orientation about the tool body longitudinal axis, and further being movably connected to the tool body so that the radial distance between the button grinding element thereon and the tool body longitudinal axis may be varied; and (e) force transmitting means in the tool body for enabling the force of a pressurized fluid in the tool body cavity to be transmitted to each elongated grinding tool and each button grinding tool, thereby extending each elongated grinding tool and button grinding tool outwardly with respect to the tool body longitudinal axis to apply a desired grinding force to the internal surface of the tubular member.

2. The apparatus of claim 1, wherein:

(a) the elongated grinding tools are positioned at a central portion of the tool body; and (b) the button grinding tools include first and second sets of button tools and the tool body includes first and second end portions on either longitudinal side of the central portion of the tool body with the first set of button tools positioned along the first end portion of the tool body and the second set of button tools positioned along the second end portion of the tool body.

3. The apparatus of claim 1 wherein:

(a) each longitudinal end of each elongated grinding tool and each button grinding tool includes a sloped portion at a radially outermost surface of the respective grinding tool with respect to the tool body longitudinal axis, each sloped portion forming a surface sloping radially inwardly toward the tool body longitudinal axis.

4. An apparatus adapted to be advanced longitudinally and rotated through a tubular member for grinding the cylindrical inner surface of the tubular member, the apparatus comprising:

(a) an elongated tool body;

(b) a plurality of elongated grinding tools each having a grinding element mounted thereon, each elongated grinding tool extending generally parallel to a longitudinal axis of the tool body and being movably mounted on the tool body so that the radial distance from the grinding element mounted thereon to the total body longitudinal axis may be varied, the elongated grinding tools being spaced out at different angular orientations about the tool body longitudinal axis;

(c) a plurality of button grinding tools, each having a button grinding element mounted thereon and being positioned at a different angular orientation about the longitudinal axis of the tool body, each of the button grinding tools also being movably connected to the tool body so that the radial distance from the button grinding element mounted thereon to the tool body longitudinal axis may be varied; and (d) force transmitting means associated with the tool body for applying pressure from an operating fluid contained in the tool body to each elongated grinding tool and each button grinding tool so that each elongated grinding tool and each button grinding tool extends outwardly from the tool body in position to apply a grinding force to the inner surface of the tubular member.

5. The apparatus of claim 4 wherein:

(a) the elongated grinding tools are positioned at a central portion of the tool body; and (b) the button grinding tools include first and second sets of button tools and the tool body includes first and second end portions on either longitudinal side of the central portion of the tool body, with the first set of button tools positioned along the first end portion of the tool body and the second set of button tools positioned along the second end portion of the tool body.

6. The apparatus of claim 4 wherein:

(a) each of the longitudinal ends of each elongated grinding tool and each button grinding tool includes a sloped portion at a radially outermost surface of the respective grinding tool with respect to the tool body longitudinal axis, each sloped portion forming a surface sloping radially inwardly toward the tool body longitudinal axis.

* * * * *